US010788298B2

(12) United States Patent
Kim et al.

(10) Patent No.: US 10,788,298 B2
(45) Date of Patent: Sep. 29, 2020

(54) BULLET WITH INCREASED EFFECTIVE RANGE

(71) Applicant: DURETEK LTD, Daejeon (KR)

(72) Inventors: Junkyu Kim, Daejeon (KR); Hyungse Kim, Daejeon (KR)

(73) Assignee: DURETEK LTD, Daejeon (KR)

( * ) Notice: Subject to any disclaimer, the term of this patent is extended or adjusted under 35 U.S.C. 154(b) by 32 days.

(21) Appl. No.: 16/091,041

(22) PCT Filed: Apr. 12, 2017

(86) PCT No.: PCT/KR2017/003939

§ 371 (c)(1),
(2) Date: Oct. 3, 2018

(87) PCT Pub. No.: WO2018/084391

PCT Pub. Date: May 11, 2018

(65) Prior Publication Data

US 2019/0277609 A1 Sep. 12, 2019

(30) Foreign Application Priority Data

Nov. 3, 2016 (KR) ..... 10-2016-0145967

(51) Int. Cl.
*F42B 10/46* (2006.01)
*F15D 1/00* (2006.01)
(Continued)

(52) U.S. Cl.
CPC ..... *F42B 10/46* (2013.01); *F15D 1/003* (2013.01); *F42B 10/38* (2013.01); *F42B 10/44* (2013.01); *F42B 33/00* (2013.01); *F42B 33/14* (2013.01)

(58) Field of Classification Search
CPC ..... F42B 10/46; F42B 10/44; F42B 10/38; F42B 19/005; F42B 10/42; F42B 12/16;
(Continued)

(56) References Cited

U.S. PATENT DOCUMENTS 1,241,409 A * 9/1917 Lizarraga ..... F42B 12/74 102/501
3,205,822 A * 9/1965 Gustafsson ..... F42C 19/04 102/399
(Continued)

FOREIGN PATENT DOCUMENTS

EP 2 053 342 4/2009
GB 191102236 A * 6/1911 ..... F42B 10/42
(Continued)

*Primary Examiner* — Joshua E Freeman
*Assistant Examiner* — Bridget A Cochran
(74) *Attorney, Agent, or Firm* — IP & T Group LLP

(57) ABSTRACT

The present invention relates to a bullet with an increased effective range. The bullet includes a front end portion (10) having a hemispherical shape, a recess portion (20) connected to a rear end of the front end portion (10) and having a curved surface that is recessed inward, an inclined portion (30) connected to a rear end of the recess portion (20) and inclined at a predetermined angle (A) with respect to a horizontal line, a stepped portion (40) connected to a rear end of the inclined portion (30) and inclined at a predetermined angle (A') with respect to the horizontal line, and fluid inducing grooves formed from the rear to a rear end surface of the bullet (1). Thus, when the bullet passes through underwater, super cavitation may be more effectively generated and maintained for even longer to significantly increase the effective range of the bullet.

6 Claims, 8 Drawing Sheets

(51) Int. Cl.
*F42B 10/44* (2006.01)
*F42B 33/00* (2006.01)
*F42B 10/38* (2006.01)
*F42B 33/14* (2006.01)

(58) Field of Classification Search
CPC ..... F42B 14/02; F42B 14/06; F42B 10/06; F42B 10/34; F15D 1/003; F41B 11/62; F41B 7/04
USPC ..... 102/399
See application file for complete search history.

(56) References Cited

U.S. PATENT DOCUMENTS 3,282,216 A * 11/1966 Calfee ..... F42B 10/46 244/159.1
3,873,048 A * 3/1975 Platou ..... F42B 10/44 244/3.1
4,176,487 A * 12/1979 Manis ..... F41A 21/00 102/470
4,572,077 A * 2/1986 Antoine ..... F42B 30/02 102/439
4,612,860 A * 9/1986 Flatau ..... F42B 12/06 102/364
4,757,766 A * 7/1988 Ruffle ..... F42B 10/46 102/521
4,813,635 A * 3/1989 Paterson ..... B62D 35/001 244/130
5,070,791 A * 12/1991 Dineen ..... F42B 10/06 102/517
5,133,261 A * 7/1992 Kelsey, Jr. ..... F42B 10/22 102/439
5,725,179 A * 3/1998 Gilman ..... F42B 10/24 102/439
5,798,478 A * 8/1998 Beal ..... F42B 10/44 102/490
6,363,856 B1 * 4/2002 Stoker, Jr. ..... F42B 10/48 102/507
6,374,743 B1 * 4/2002 Hug ..... F42B 12/74 102/514
7,150,234 B2 * 12/2006 Gilman ..... F42B 8/12 102/517
7,779,759 B2 * 8/2010 Paulic ..... F42B 10/22 102/399
8,082,850 B2 * 12/2011 Marx ..... F42B 10/26 102/501
8,082,851 B2 * 12/2011 Polovnev ..... F42B 6/08 102/518
8,307,768 B2 * 11/2012 Cziglenyi ..... F42B 30/02 102/439
2006/0027128 A1 * 2/2006 Hober ..... F42B 14/06 102/514
2006/0096491 A1 * 5/2006 Fichot ..... F42B 10/22 102/501
2007/0144395 A1 * 6/2007 Yaich ..... B23B 27/06 102/439
2007/0151474 A1 * 7/2007 Widener ..... F42B 10/24 102/501
2007/0204758 A1 * 9/2007 Spatz ..... F42B 12/74 102/514
2008/0264290 A1 * 10/2008 Salvel ..... F42B 30/02 102/517
2009/0173248 A1 * 7/2009 Fu ..... F42B 15/22 102/399
2011/0297031 A1 * 12/2011 Fu ..... F42B 10/06 102/399
2013/0180424 A1 * 7/2013 Kim ..... F42B 10/44 102/501
2016/0153757 A1 * 6/2016 Mahnke ..... F42B 10/22 102/501
2017/0199019 A1 * 7/2017 Fricke ..... F42B 12/04

FOREIGN PATENT DOCUMENTS

JP 2006-132874 5/2006
JP 2007-537416 12/2007
KR 1020070106558 11/2007
KR 101347167 1/2014
KR 101568319 11/2015
KR 101660887 9/2016
WO WO-2016148369 A1 * 9/2016 ..... F42B 10/42

* cited by examiner

BULLET WITH INCREASED EFFECTIVE RANGE

This application is a national stage application of PCT/KR2017/003939 filed on Apr. 12, 2017, which claims priority of Korean patent application number 10-2016-0145967 filed on Nov. 3, 2016. The disclosure of each of the foregoing applications is incorporated herein by reference in its entirety.

FIELD OF THE INVENTION

The present invention relates to a bullet with an increased effective range, and more particularly, to a bullet with an increased effective range, in which super cavitation is effectively generated around the bullet when the bullet is shot into air or water to increase the effective range, thereby improving accuracy (accuracy rate) of striking.

DESCRIPTION OF THE RELATED ART

A bullet loaded in and shot from a projectile is composed of gunpowder generating firing energy by explosion and a warhead flying to a target by the firing energy. When the bullet is manufactured, a jacket made of a copper alloy is generally manufactured in a conical shape having a space therein through mechanical machining such as forging, and then, melted metal such as lead is injected into the inner space of the jacket by using a nozzle.

Also, a bullet having a structure, in which a groove is formed in an outer circumferential surface of the bullet so that flying resistance is reduced to increase an effective range when the bullet is shot to fly in air and also to improve accuracy, and a groove deeply recessed in a front inner direction is formed in a rear surface of the bullet to fill gunpowder into the groove, is being used.

However, although the bullet having the above-described structure is increased in effective range and improved in accuracy when shot in air, if the bullet is used as a bullet for underwater launch, the deep groove formed in the rear surface of the bullet may generate excessive vortex. Thus, the bullet having the above-described structure is not suitable for a bullet for underwater.

Also, in the bullet into which a soft metal such lead is filled, the lead filled into the bullet is instantly compressed and then expanded toward the jacket by explosive power of the gunpowder, and thus, the jacket is expanded also to increase a contact between a barrel and the bullet and effectively transfer the explosive power to the bullet, thereby increasing the effective range. However, if the bullet having the above-described structure is used for the underwater launch, although the explosive power is effectively transferred to the bullet, the jacket forming an outer appearance of the bullet is contracted by a water pressure applied to a front surface of the bullet when the bullet advances in the underwater, and thus, the lead filled in the jacket is pushed to a rear side of the bullet. As a result, the jacket is deformed to significantly deteriorate the accuracy.

Due to the above-described reasons, when the bullet advances in the underwater, the effective range is extremely shortened, and also the accuracy is reduced when compared to the case in which the bullet flies in air. To solve this problem, European Patent Application No. 2053342 and US Patent Application No. 2011-0297031 are disclosed, in which a stepped portion or an inclined surface is formed at the front of a bullet as illustrated in FIG. 1A to artificially generate bubbles in a front surface of the bullet and cause super cavitation, in which an outer circumferential surface of the bullet is surrounded by the bubbles, by taking reversely disadvantage of the bubbles when the bullet advances in underwater, thereby reducing water resistance acting on the surface of the bullet and improving an effective range of the bullet.

However, when the bullet is gradually reduced in advancing speed while the bullet advances in the underwater, air constituting the bubbles is reabsorbed into the water. Thus, since the effective super cavitation around the bullet as described above is not generated to gradually reduce a size of a cavity existing between the outer circumferential surface and the water. Furthermore, as illustrated in FIG. 1B, when the water contacts the outer circumferential surface of the bullet, a resistance reduction effect of the water due to the super cavitation is gone to sharply reduce the advancing speed of the bullet, and thereby to reduce the effective range. Therefore, development of a bullet in which the super cavitation generated around the bullets is maintained for even longer to increase the effective range of the bullet is being required.

SUMMARY OF THE INVENTION

Problem to be Solved of the Invention

The present disclosure is contrived to solve the foregoing problems of the bullet according to the related art, and an object of the present invention is to provide a bullet having a structure in which super cavitation is more effectively generated around the bullet flying in air or underwater and maintained for even longer to increase an effective range.

Means for Solving Problems

According to an aspect of the present invention, there is provided a bullet with an increased effective range, which has a streamlined shape on the whole and is shot into air and underwater to strike a target, the bullet including: a front end portion having a hemispherical shape; a recess portion connected to a rear end of the front end portion and having a curved surface that is recessed inward; an inclined portion connected to a rear end of the recess portion and inclined at a predetermined angle with respect to a horizontal line; a stepped portion connected to a rear end of the inclined portion and inclined at a predetermined angle with respect to the horizontal line; and fluid inducing grooves formed from the rear to a rear end surface of the bullet.

The angle of the stepped portion may be greater than the angle of the inclined portion.

An installation hole communicating backward may be formed in the bullet, and a projectile and a rear assembly may be inserted into and assembled within the installation hole.

A front end portion, a recess portion, an inclined portion, and a stepped portion, which respectively have the same shape as the front end portion, the recess portion, the inclined portion, and the stepped portion, may be formed on the front of the projectile.

The bullet may further include: a main body having a cylindrical shape, in which the fluid inducing grooves are formed in the rear thereof, an installation hole passing in a front and rear direction thereof is formed therein, and a bubbling groove is formed in an outer circumferential surface thereof; a front assembly inserted and installed to the front of the installation hole so as to be exposed to a front side of the main body; and a rear assembly assembled with the rear of the installation hole, wherein the front assembly may include: a protrusion part protruding to the front side of the main body; and an insertion part disposed at a rear side of the protrusion and inserted into the installation hole.

At least one coupling groove may be formed in the projectile or the insertion part.

The front of the installation hole may have a diameter greater than that of the insertion part so that the front of the installation hole is spaced a predetermined distance from the insertion part.

Effect of Invention

According to the present invention, when the bullet flies in the air, the air may be uniformly induced to the central portion of the rear end surface of the bullet by the air inducing groove formed in a rear side of the bullet to generate turbulence and prevent the bullet from being shaken. Thus, the bullet may be stably flied to improve the effective range and accuracy. When the bullet advances in the underwater, the super cavitation may be more effectively generated by the front end portion, the recess portion, the inclined portion, and the stepped portion, which are provided on the bullet, to significantly increase the size of the cavity between the surface of the bullet and the water when compared to that of the bullet according to the related art and also may be maintained for even longer to significantly increase the effective range of the bullet. Therefore, the bullet may be stably flied and improved in accuracy.

EXPLANATION OF MARKS

Figure 1A:
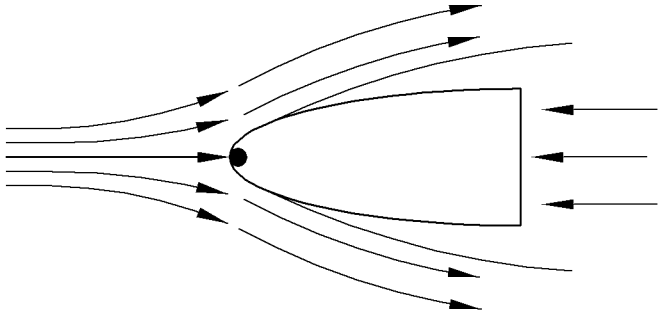
FIGS. 1*a* and 1*b* are views illustrating an example in which super cavitation is generated around a bullet and then dissipated.
Figure 1B:
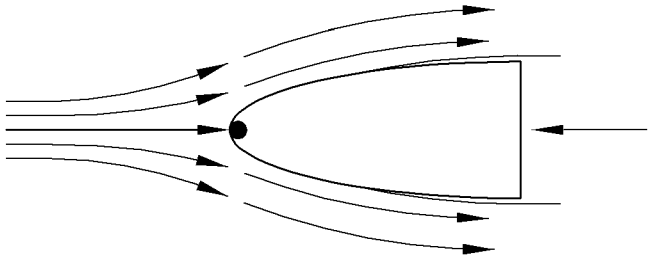

| | |
|---|---|
| 1: a bullet | 1A: an installation hole |
| 1B: a bubbling groves | 10: a front end portion |
| 20: a rear end of the recess portion | 30: an inclined portion |
| 40: a stepped portion | 50: a fluid inducing grooves |
| 60: a projectile | 61: a front end portion |
| 62: a recess portion | 63: an inclined portion |

-continued

| | |
|---|---|
| 64: a stepped portion | 65: a coupling grooves |
| 70: a rear assembly | 100: a main body |
| 110: an installation hole | 120: a bubbling groove |
| 200: a front assembly | 210: a protrusion part |
| 220: an insertion part | 221: a coupling grooves |
| 300: a rear assembly | A: a predetermined angle |
| A′: angle of a stepped portion | |
| CL: virtual center-line of a bullet | |
| L1: length of a rear end of the recess portion | |
| L2: length of an inclined portion | |

DETAILED DESCRIPTION OF THE INVENTION

Hereinafter, configurations and effects of the present invention will be described in more detail with reference to the accompanying drawings illustrating preferred embodiments.

The present invention is to provide a bullet in which super cavitation is effectively generated around an outer circumferential surface of the bullet and maintained for even longer while the bullet advances in air and underwater to increase an effective range. For this, as illustrated in FIGS. 2 and 3, the bullet 1 of the present invention includes a front end portion 10, a recess portion 20, an inclined portion 30, a stepped portion 40, and a fluid inducing groove 50 in order from a front end thereof.

Also, for convenience of description, a case in which the bullet advances in the underwater, instead of a case in which the bullet flies in the air, will be described below.

Figure 2:
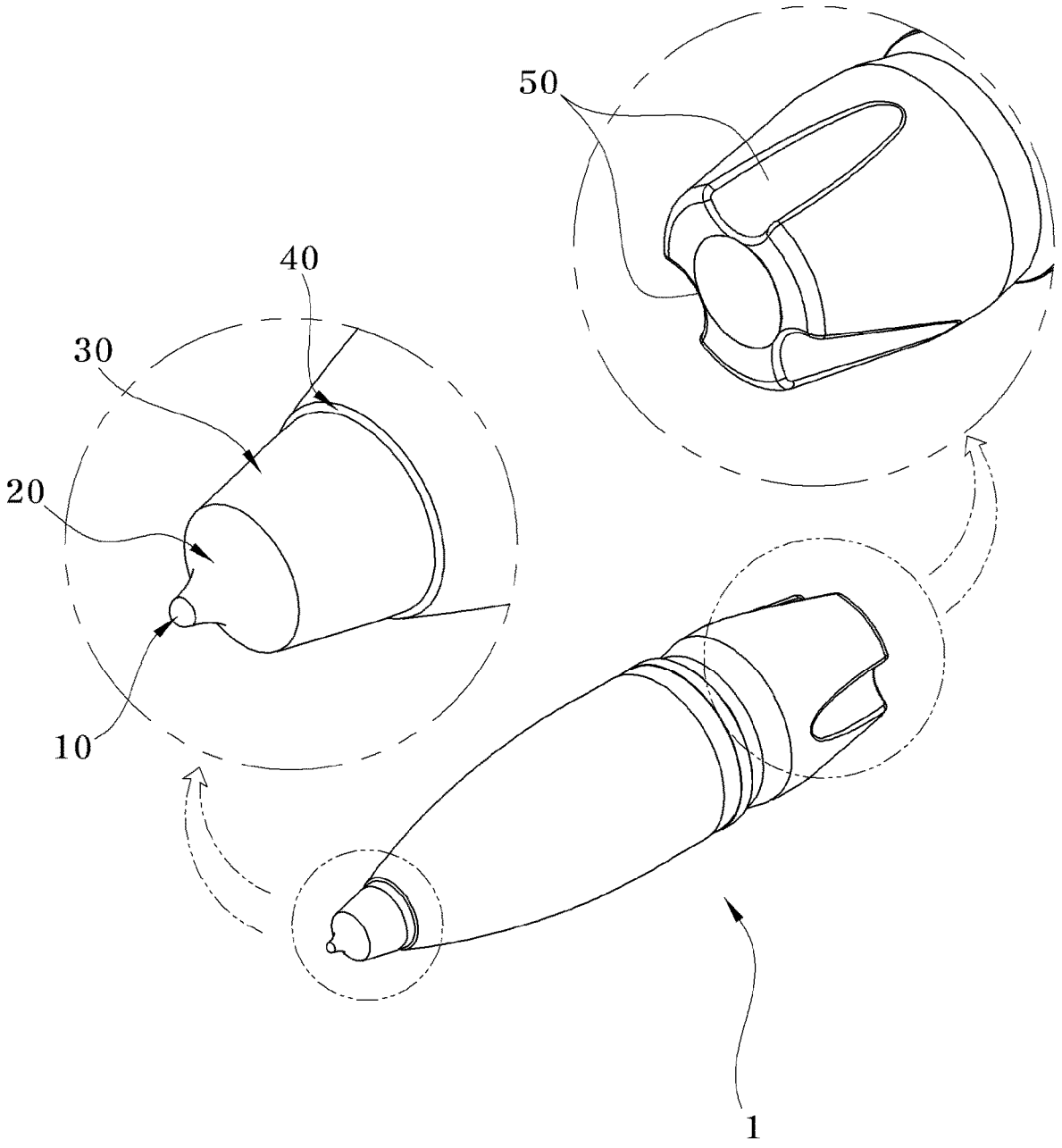
FIG. 2 is a perspective view illustrating an example of the bullet having an increased effective range according to the present invention.

As illustrated in FIG. 2, the front end portion 10 having a hemispherical shape is provided on a front end of the bullet. When the bullet 1 is shot into air to advance in the underwater at a high speed, a flow of the water may be guided along the hemispherical shape of the front end portion 10 due to the structure of the front end portion 10, thereby improving advancing performance of the bullet 1 in the underwater. Also, the water flows along a tangential direction of the front end portion 10 having the hemispherical shape at the end of the front end portion 10 and then be spread outward. Thus, the super cavitation may be easily generated at the end of the front end portion 10 of the bullet 1.

Figure 3:
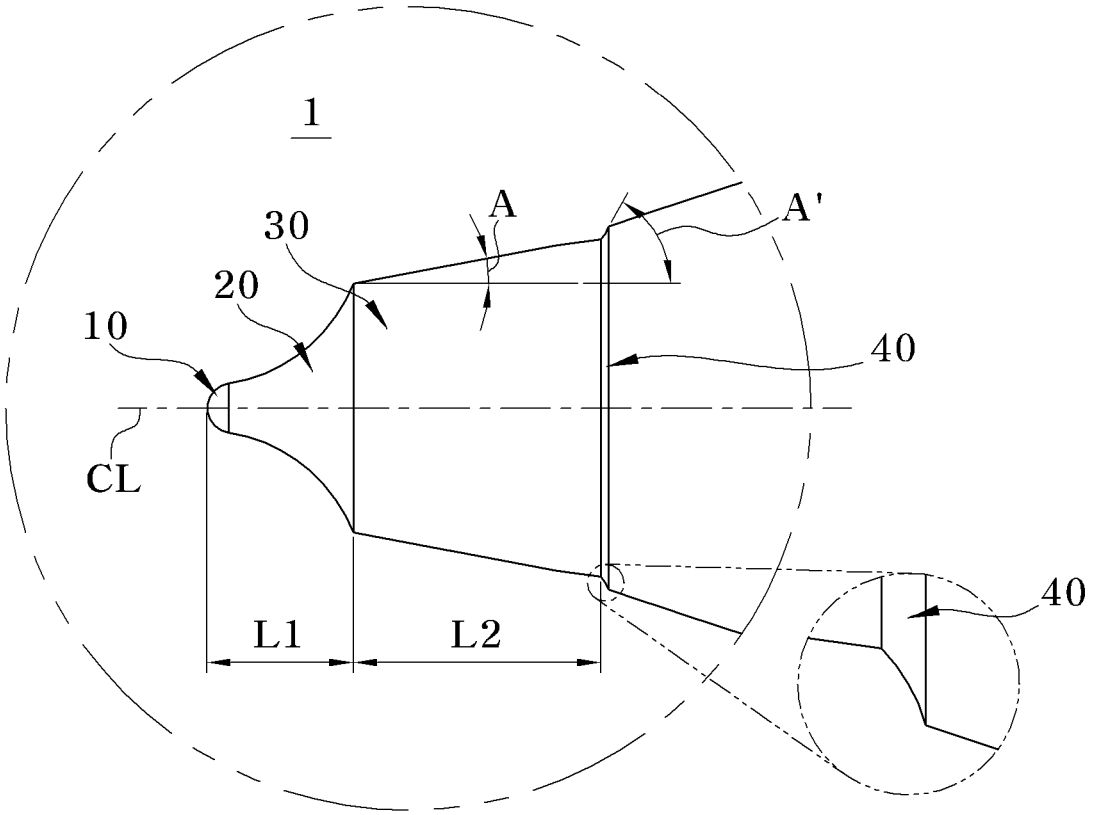
FIG. 3 is a partial enlarged view of a front end portion, a recess portion, an inclined portion, and a stepped portion according to the present invention.

Also, the recess portion 20 having a curved surface that is recessed inward as illustrated in FIG. 3 is provided on a rear side of the front end portion 10 so that the end of the front end portion 10 becomes an inflection point. As a result, a pressure of the water is suddenly reduced at the recess portion 20, and thus, the air dissolved in the water is deformed into bubbles by a low pressure (vacuum state) to accelerate generation of an empty space, which is generated by the super cavitation, between the outer circumferential surface of the bubble 1 and the water, i.e., cavity, thereby reducing resistance of the water acing on the bullet 1 and improving the effective range of the bullet 1. Thus, the bullet 1 may stably advance in the underwater to improve the accuracy of the striking.

Since the recess portion 20 having the curved shape that is recessed inward is provided on a rear side of the front end portion 10 as described above, the water flowing around the outer circumferential surface of the bullet 1 may be farther away from the outer circumferential surface of the bullet 1. Thus, the super cavitation may be maintained for even longer, and the effective range may be increased when compared to the bullet (underwater bullet) according to the related art.

As illustrated in FIG. 3, the inclined portion 30 forming a plane that is inclined at a predetermined angle A with respect to a virtual central line CL of the bullet 1 to extend backward is provided on a rear side of the recess portion 20 to prevent a distance between a surface of the cavity formed around the bullet 1 and the outer circumferential surface of the bullet 1 from being suddenly reduced and guide the flow of the water to a rear side of the bullet 1 so that the bullet 1 stably advances. Here, the inclined portion 30 may have a length L2 greater than that L1 of the recess portion 20.

Figure 4A:
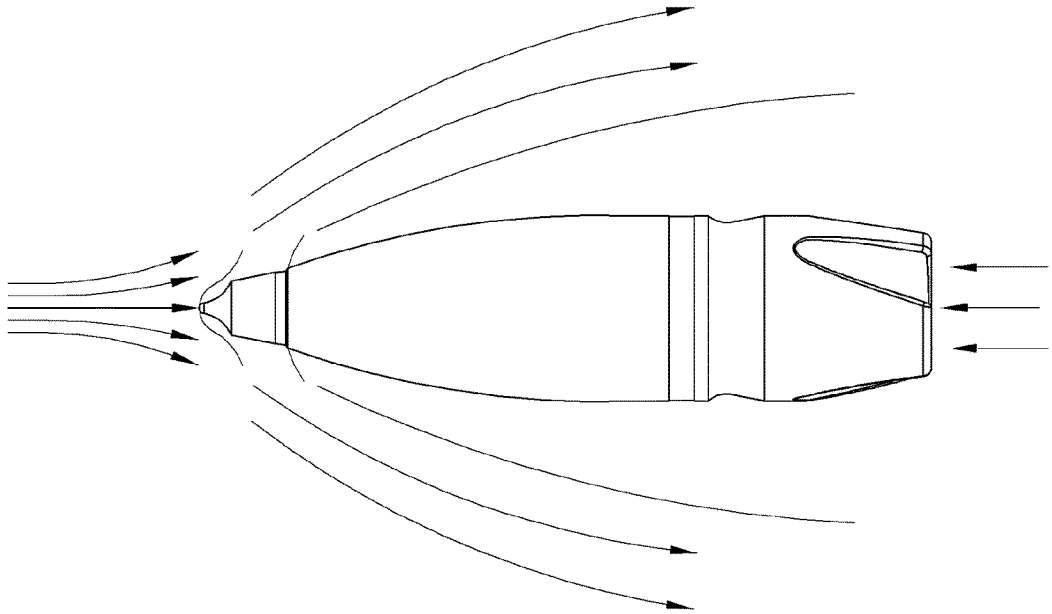
FIGS. 4*a* and 4*b* are views illustrating an example in which the super cavitation is generated around the bullet having the increased effective range according to the present invention.
Figure 4B:
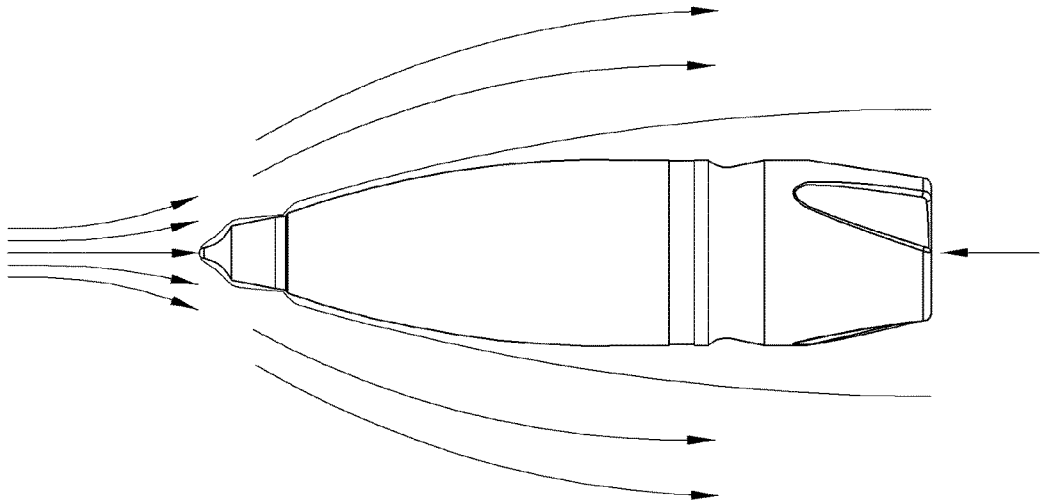

Also, the cavity may be reduced in size while the water flows along the inclined portion 30, and thus the water may approach the surface of the bullet 1. In this case, the advancing speed of the bullet 1 may be significantly reduced. To prevent this phenomenon from occur in the present invention, as illustrated in FIGS. 4*a* and 4*b*, the stepped portion 40 forming a plane that is inclined at a predetermined angle A' with respect to the virtual central line CL of the bullet 1 may extend from an end of the inclined portion 30. Here, the angle A' of the stepped portion 40 may be greater than that A of the inclined portion 30.

The cavity around the bullet 1, which comes close up to the surface of the bullet 1 by the above-described stepped portion 40, may meet the stepped portion 40 to regenerate the super cavitation, thereby again increasing a size of the cavity around the bullet 1 and reducing the resistance of the water around the bullet 1.

A streamlined portion (not shown) forming a horizontal surface together with an outwardly protruding surface of the bullet 1 extends at a rear side of the stepped portion 40. The flow of the water is guided by the streamlined portion to smoothly advance in the underwater. Three fluid inducing grooves 50 are formed from the rear of the streamlined portion to a rear end surface approximately vertically formed on the rear of the streamlined portion at the end of the streamlined portion. When the bullet 1 is shot to fly in the air and advance in the underwater, the flows of the air and water are uniformly induced to a center of the rear end surface of the bullet 1 and forms turbulence by the fluid inducing groove 50 so that the shaking of the bullet 1 is prevented to stably fly. Thus, the accuracy rate of the bullet 1 may be improved, and the flying resistance may be reduced to help the extension of the effective range.

As illustrated in FIG. 2, the three fluid inducing grooves 50 is inclined at the same an angle and in the same direction with respect to a straight line passing through the center of the rear end surface of the bullet 1, and ends of the fluid inducing grooves 50 may be spaced a predetermined distance from each other from the center of the rear end surface of the bullet 1.

When the bullet 1 having the above-described structure and the increased effective range is manufactured, the front end portion 10, the recess portion 20, the inclined portion, and the stepped portion 40 may be integrally manufactured with the rear of the bullet 1 or be assembled with the rear of the bullet 1. Hereinafter, each of the cases will be described as one exemplary embodiment.

Embodiment 1

Figure 5:
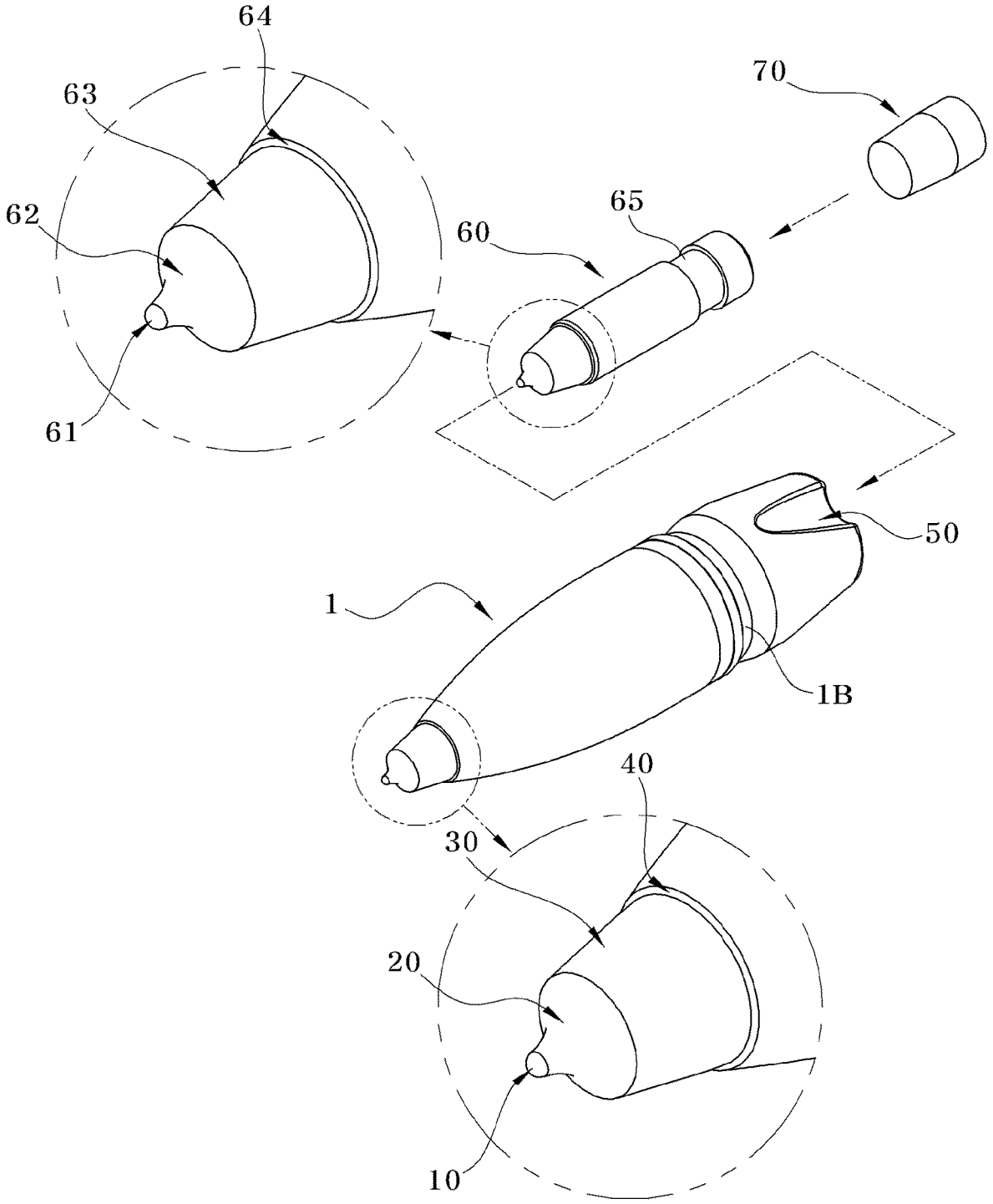
FIG. 5 is an exploded perspective view illustrating a first embodiment associated with manufacturing of the bullet having the increased effective range according to the present invention.
Figure 6:
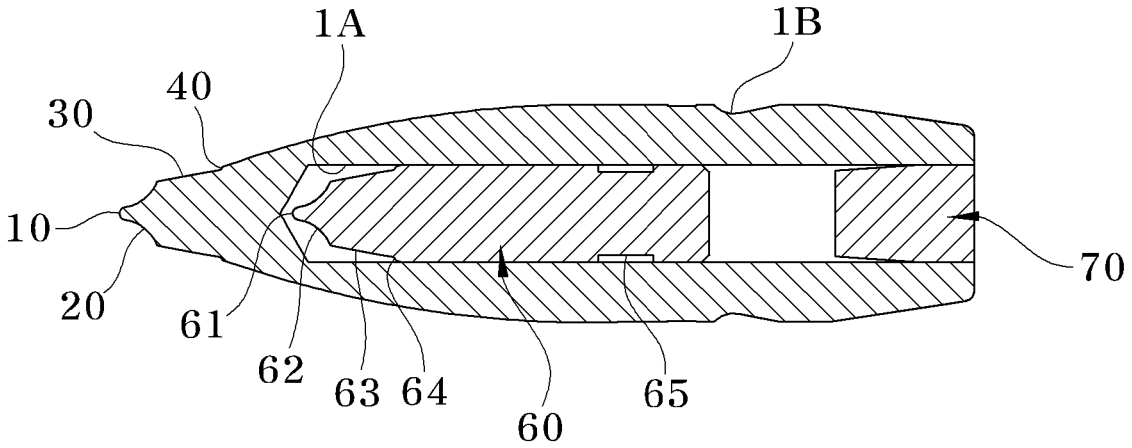
FIG. 6 is a cross-sectional view of FIG. 5.

According to Embodiment 1, as illustrated in FIGS. 5 and 6, an outer shell of a bullet 1 is made of a metal such as a copper alloy. As described above, a front end portion 10, a recess portion 20, an inclined portion 30, a stepped portion 40, a streamlined portion, and a fluid inducing groove 50 are sequentially formed on an outer circumferential surface and a rear end surface of the bullet 1. Also, an installation hole 1A extending backward is formed along a virtual central line CL within the bullet 1. A bubbling groove 1B having a recessed shape in a circumferential direction is formed in a portion of the outer circumferential surface, and a front portion of a projectile 60 having an outer circumferential surface with the same outer circumferential surface as that of each of the front end portion 10, the recess portion 20, the inclined portion 30, and the stepped portion 40, which are formed on the outer shell of the bullet 1, is inserted and installed in the installation hole 1A. A rear assembly 70 is inserted into and assembled with a rear side of the projectile 60 at a predetermined distance, and an empty space is formed between the projectile 60 and the rear assembly 70 to reduce a weight of the bullet 1.

Here, the projectile 60 inserted into and installed in the installation hole 1A formed in the outer shell of the bullet 1 is manufactured by using a soft metal such as tungsten or a tungsten alloy that has stiffness superior to that of the outer shell. At least one coupling groove 65 is formed at a rear side of the projectile 60. Here, the outer shell made of a relatively soft material when compared to the projectile 60 may be press-fitted into the coupling groove 65 by applying force from the outside of the outer shell of the bullet 1, and thus, the projectile 60 inserted into the installation hole 1A may be firmly fixed inside the outer shell of the bullet 1.

According to the above-described material characteristics and structure, when the bullet 1 is shot to enter into the water and approach a target, the outer shell made of the soft metal is ruptured by an impact, and thus, the projectile 60 installed in the outer shell is out of the outer shell to penetrate the target. Here, since a front end portion 61, a recess portion 62, an inclined portion 63, and a stepped portion 64 are formed also on the projectile 60, resistance force generated while the bullet 1 strikes the target may be significantly reduced to improve the striking performance to the target.

Embodiment 2

Figure 7:
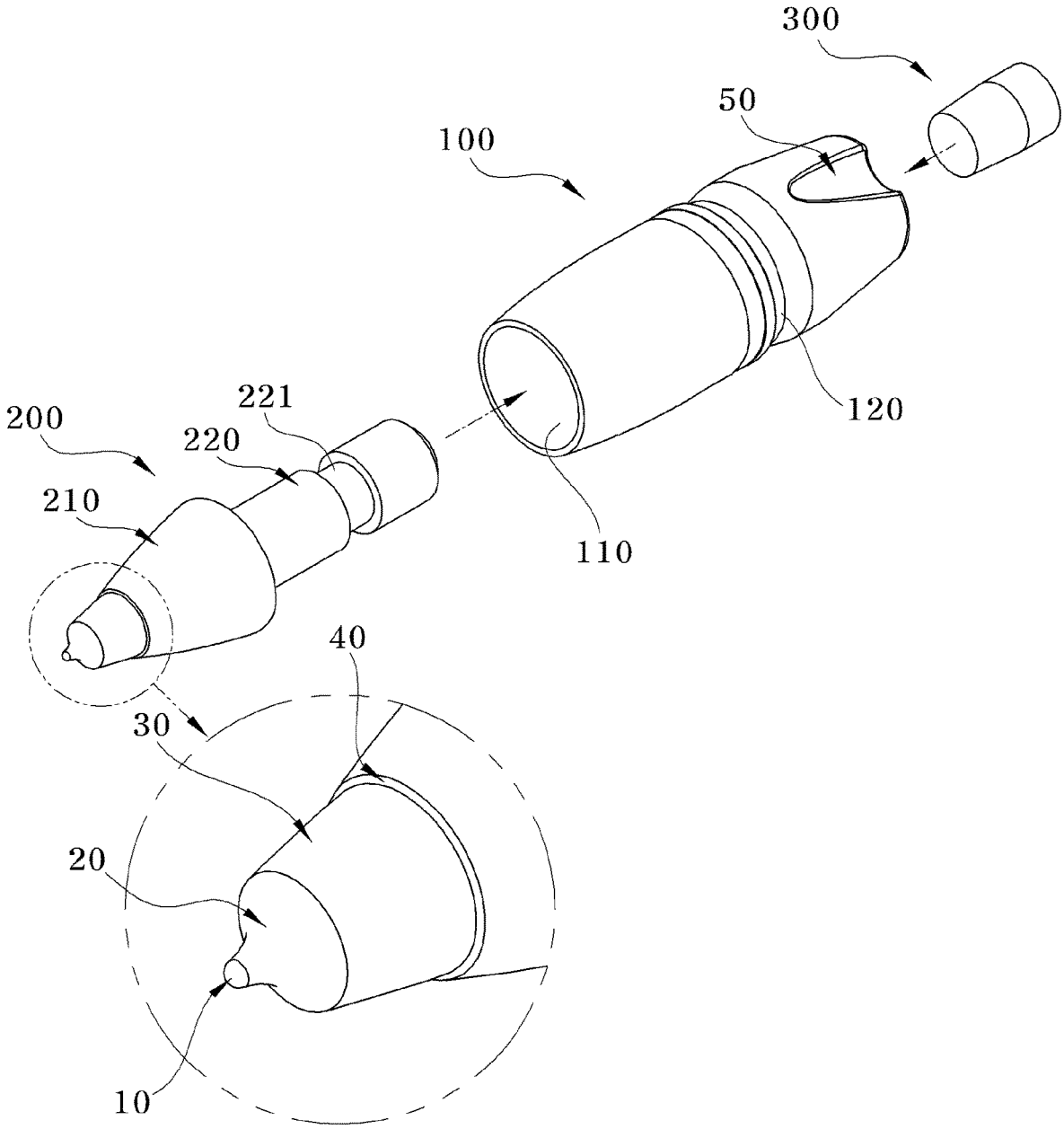
FIG. 7 is an exploded perspective view illustrating a second embodiment associated with manufacturing of the bullet having the increased effective range according to the present invention.
Figure 8:
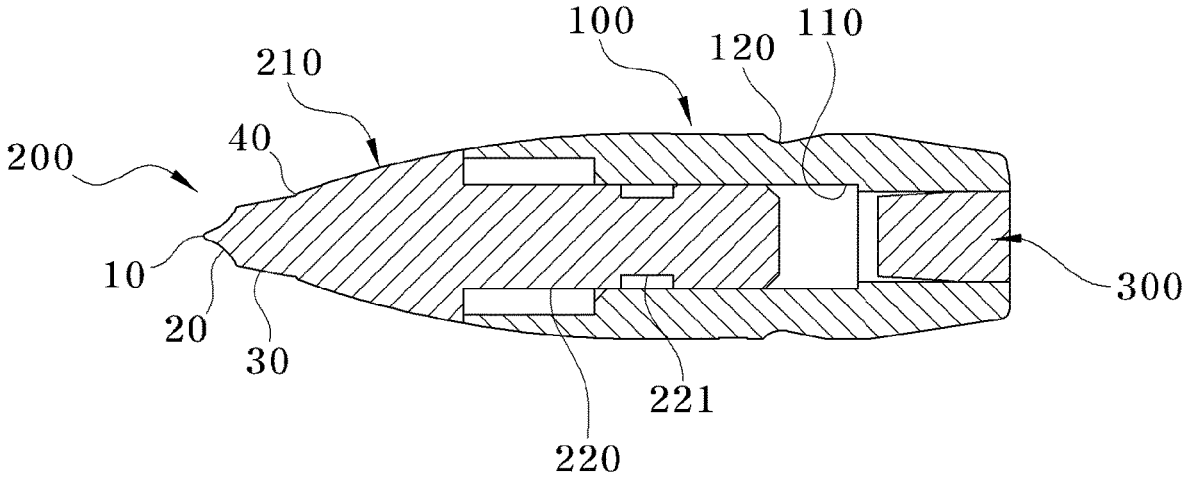
FIG. 8 is a cross-sectional view illustrating the spindle and the susceptor of FIG. 7.

As illustrated in FIGS. 7 and 8, Embodiment 2 relates to a bullet 1 having a structure in which a main body 100, a front assembly 200, and a rear assembly 300, which constitute the bullet 1, are separately manufactured and then assembled with each other to manufacture the bullet 1. The main body 100 has a cylindrical shape, and an installation hole 111 passing in a front and rear direction of the main body 100 is formed in an inner center of the main body 100. A bubbling groove 120 having a recessed shape in a circumferential direction is formed in a portion of an outer circumferential surface of the main body 100, and three fluid inducing grooves 60 as described above are formed in a rear side of the main body 100.

Here, a front diameter of the installation hole 110 has a greater than that of an insertion part 220 so that the front of the installation hole 110 is spaced a predetermined distance from the insertion part 220 of the front assembly. As a result, the bullet 1 may be reduced in weight.

Also, when the front assembly 200 is installed on the main body 100, the front assembly 200 fitted into and installed in the front of the installation hole 110 is constituted by a protrusion part 210 exposed to a front side of the main body 100 and the insertion part 220 disposed at a rear side of the protrusion part 210 and inserted into the installation hole 110 of the main body 100. Here, as described above, a front end portion 10, a recess portion 20, an inclined portion 30, and a stepped portion 40 are formed on the protrusion part 210.

Also, the rear assembly 300 is inserted and installed in the rear of the installation hole 110 formed in the main body 100 so as to be spaced a predetermined distance from a rear end of the front assembly 200. Since an empty space is formed between the front assembly 200 and the rear assembly 300, the bullet 1 may be reduced in weight.

Also, the front assembly 200 is manufactured by using a hard metal such as tungsten or a tungsten alloy that has stiffness superior to that of the main body 100 made of a material such as a copper alloy. Like Embodiment 1, since at least one coupling groove 221 is formed in an outer circumferential surface of the rear of the insertion part 220 of the front assembly 200, the main body 100 and the front assembly 200 may be firmly coupled to each other.

Due to the above-described material characteristics and structure of the bullet 1, when the bullet 1 is shot to enter into the water and approach a target, the front assembly 200 may be maintained in shape as it is without being damaged even though an impact on the water or the target occurs. Thus, the superior striking performance of the bullet 1 to the target may be secured. As described above, the present invention may provide the bullet having the increased effective range and superior striking performance by more effectively generating the super cavitation and maintaining the super cavitation for even longer when the bullet passes through the air or underwater.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A bullet with an increased effective range, which has a streamlined shape on the whole and is shot into air or underwater to strike a target, the bullet comprising: a front end portion having a hemispherical shape; a recess portion connected to a rear end of the front end portion and having a curved surface that is recessed inward; an inclined portion connected to a rear end of the recess portion and inclined outwardly at a predetermined angle with respect to a horizontal line; a stepped portion connected directly to a rear end of the inclined portion and inclined outwardly at a predetermined angle with respect to the horizontal line; a streamlined portion connected to a rear end of the stepped portion and having an outwardly protruding surface extended at the rear end of the stepped portion; and a tail portion connected to the streamlined portion and having an outer surface and a rear surface; wherein the tail portion has fluid inducing grooves formed from the rear surface to the outer surface of the tail portion, and the angle of the stepped portion is greater than that of the inclined portion.

2. The bullet of claim 1, wherein an installation hole communicating backward is formed in the bullet, and a projectile and a rear assembly are inserted into and assembled within the installation hole.

3. The bullet of claim 2, wherein a front end portion, a recess portion, an inclined portion, and a stepped portion, which respectively have the same shape as the front end portion, the recess portion, the inclined portion, and the stepped portion, are formed on the front of the projectile.

4. The bullet of claim 1, further comprising:

a main body having a cylindrical shape, in which the fluid inducing grooves are formed in the rear thereof, an installation hole passing in a front and rear direction thereof is formed therein, and a bubbling groove is formed in an outer circumferential surface thereof;

a front assembly inserted and installed to the front of the installation hole so as to be exposed to a front side of the main body; and a rear assembly assembled with the rear of the installation hole, wherein the front assembly comprises:

a protrusion part protruding to the front side of the main body; and an insertion part disposed at a rear side of the protrusion and inserted into the installation hole.

5. The bullet of claim 2, wherein at least one coupling groove is formed in the projectile.

6. The bullet of claim 4, wherein the front of the installation hole has a diameter greater than that of the insertion part so that the front of the installation hole is spaced a predetermined distance from the insertion part.

* * * * *